US006147440A

United States Patent [19]

Scholz et al.

[11] Patent Number: 6,147,440

[45] Date of Patent: Nov. 14, 2000

[54] LOW WATTAGE LAMP HAVING FORMED ARC TUBE IN ALUMINOSILICATE OUTER JACKET

[75] Inventors: John A. Scholz, Georgetown; Joseph V. Lima, Salem; Edward H. Nortrup, Stoneham; Zeya K. Krasko, Peabody, all of Mass.; Peter R. Gagnon; Joseph P. Gallant, both of Lexington, Ky.

[73] Assignee: Osram Sylvania Inc., Danvers, Mass.

[21] Appl. No.: 09/133,639

[22] Filed: Aug. 13, 1998

Related U.S. Application Data

[60] Provisional application No. 60/058,548, Sep. 11, 1997.

[51] Int. Cl.[7] ..... H01J 5/16

[52] U.S. Cl. ..... 313/113; 313/234; 313/641; 313/25; 313/559

[58] Field of Search ..... 313/113, 234, 313/571, 659, 639, 25

[56] References Cited

U.S. PATENT DOCUMENTS

| | | | |
|---|---|---|---|
| 3,341,731 | 9/1967 | Wilson | 313/113 |
| 4,916,353 | 4/1990 | Danko et al. | 313/113 |
| 4,935,668 | 6/1990 | Hansler et al. | 315/82 |
| 4,961,019 | 10/1990 | White et al. | 313/25 |
| 5,108,333 | 4/1992 | Heider et al. | 445/26 |
| 5,225,733 | 7/1993 | Krasko | 313/25 |
| 5,359,255 | 10/1994 | Kawai et al. | 313/17 |
| 5,576,598 | 11/1996 | Zaslavsky et al. | 313/623 |
| 5,694,002 | 12/1997 | Krasko et al. | 313/641 |
| 5,959,404 | 9/1999 | Nortrup et al. | 313/634 |

FOREIGN PATENT DOCUMENTS

| | | | |
|---|---|---|---|
| 0363991 | 10/1989 | European Pat. Off. | H01J 61/34 |
| 2644933 | 3/1990 | France | H01K 1/42 |
| 4334074 | 4/1995 | Germany | H01J 61/22 |
| 9627205 | 9/1996 | WIPO | H01K 1/46 |

*Primary Examiner*—Nimeshkumar D. Patel
*Assistant Examiner*—Karabi Guharay
*Attorney, Agent, or Firm*—William H. McNeill

[57] ABSTRACT

A reflector lamp 10 has a vitreous outer envelope 12 formed of a concave reflector 14 and a light-transmitting 16 cover peripherally sealed thereto. The concave reflector and cover are symmetrically arrayed about a longitudinal axis 18 and a substantially cylindrical, hollow neck 20 having a given depth is affixed to the concave reflector opposite the cover. The neck 20 also is symmetrically arrayed about the longitudinal axis 18 and has a substantially closed bottom 21. At least two eyelets, 22, 24, respectively, are sealed in the bottom 21 and a light source capsule 26 is positioned in the concave reflector and aligned with the longitudinal axis 18. The light source capsule 26 has a first end 28 situated in the neck 20 and a second end 30 extending into the concave reflector. The light source capsule 26 comprises a quartz arc tube 32 containing an arc generating and sustaining medium and a surrounding aluminosilicate glass shroud 34. First and second conductive lead-ins 36, 38, respectively, are sealed into a first seal 40 formed at a first end 42 of the shroud 34. Each of the lead-ins 36, 38 has a first portion 44, 46, respectively, sealed in one of the eyelets 22, 24. The first conductive lead-in 36 has a second portion 48 extending interiorly of the shroud and connecting a first electrode 50 of the arc tube and contains a bend or offset 49 to take expansion differences during operation. The second lead-in 38 has a second portion 54 terminating within the first seal 40. An outer conductor 56 has a first end 58 sealed in a second end 60 of the shroud 34 and connects a second electrode 62 of the arc tube 32. A middle section 64 of the outer conductor 56, which is surrounded by an electrically insulating sleeve 57 for at least part of its length, extends exteriorly of the shroud 34 and has a second end 66 connected to the second said lead-in 38. A conventional screw base 68 completes the lamp.

10 Claims, 2 Drawing Sheets

LOW WATTAGE LAMP HAVING FORMED ARC TUBE IN ALUMINOSILICATE OUTER JACKET

This application claims the benefit of Provisional Patent Application Ser. No. 60/058,548, filed Sep. 11, 1997.

TECHNICAL FIELD

This invention relates to arc discharge lamps and particularly to low wattage, reflector lamps containing an arc discharge light source surrounded by a shroud or shield.

BACKGROUND ART

Reflector lamps have wide applications as spot or floodlights. Many versions exist in both incandescent and high intensity discharge lamp varieties. The high intensity discharge lamp varieties, while generally more expensive than the incandescent, are favored because of their longer life and much higher efficacy. These lamps comprise a vitreous outer envelope formed of a concave reflector and have a light-transmitting cover peripherally sealed thereto. An elongated arc tube is positioned within the lamp body, usually longitudinally aligned with the lamp longitudinal axis. The arc tube body is formed of quartz and has the usual lead-ins and electrodes made of tungsten sealed therein by means of a molybdenum foil, as is known. Often, one of the leads for the lamp is connected through the light-transmissive cover, which cover can also functions as a lens, as is shown in U.S. Pat. No. 3,341,731. In other lamps, such as are shown in U.S. Pat. No. 5,359,255, a quartz shroud surrounds the arc tube and greatly increases the length of the assembly, necessitating modification to the lower end of the lamp. The increased length is caused by the additional tungsten-moly foil seals needed. The latter problem can be decreased by using an aluminosilicate glass shroud, as taught in U.S. Pat. No. 4,935,668; however, the mounting method used in such lamps creates alignment problems since the mass of the suspended arc tube assembly often shifts upon impacts such as those imparted by shipping. Additionally, the lamp of U.S. Pat. No. 4,935,668 requires the outer jacket to be hermetic. Yet another approach has utilized a small ceramic arc tube sealed within a quartz shroud. This latter technique also increases the length of the arc tube assembly and requires modification of the base of the lamp.

DISCLOSURE OF INVENTION

It is, therefore, an object of this invention to obviate the disadvantages of the prior art.

It is yet another object of the invention to enhance high intensity discharge reflector lamps.

Yet another object of the invention is the provision of a ruggedized high intensity discharge reflector lamp.

These objects are accomplished, in one aspect of the invention, by the provision of a reflector lamp that comprises a vitreous outer envelope formed of a concave reflector and a light-transmitting cover peripherally sealed thereto. The concave reflector and cover are symmetrically arrayed about a longitudinal axis and a substantially cylindrical, hollow neck having a given depth is affixed to the concave reflector opposite the cover. The neck also is symmetrically arrayed about the longitudinal axis and has a substantially closed bottom. At least two eyelets are sealed in the bottom and a light source capsule is positioned in the concave reflector. The light source capsule has a first end situated in the neck and a second end extending into the concave reflector. The light source capsule comprises a quartz arc tube containing an arc generating and sustaining medium and a surrounding aluminosilicate glass shroud and first and second conductive lead-ins sealed into a first seal formed at a first end of said shroud. Each of the lead-ins has a first portion sealed in one of the eyelets. The first conductive lead-in has a second portion extending interiorly of the shroud and connecting a first electrode of the arc tube and the second lead-in has a second portion terminating within the first seal. An outer conductor has a first end sealed in a second end of the shroud and connects a second electrode of the arc tube. A middle section of the outer conductor extends exteriorly of the shroud and has a second end connected to the second said lead-in.

This construction greatly improves arc discharge reflector lamps. The assembly is rugged, both because of its solid fit within the neck of the lamp envelope and its short, length. It is economical because the seal complexity is reduced by the use of the aluminosilicate shroud, which eliminates the need for moly foil seals. Further, it is not necessary to modify the bottom of the lamp.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
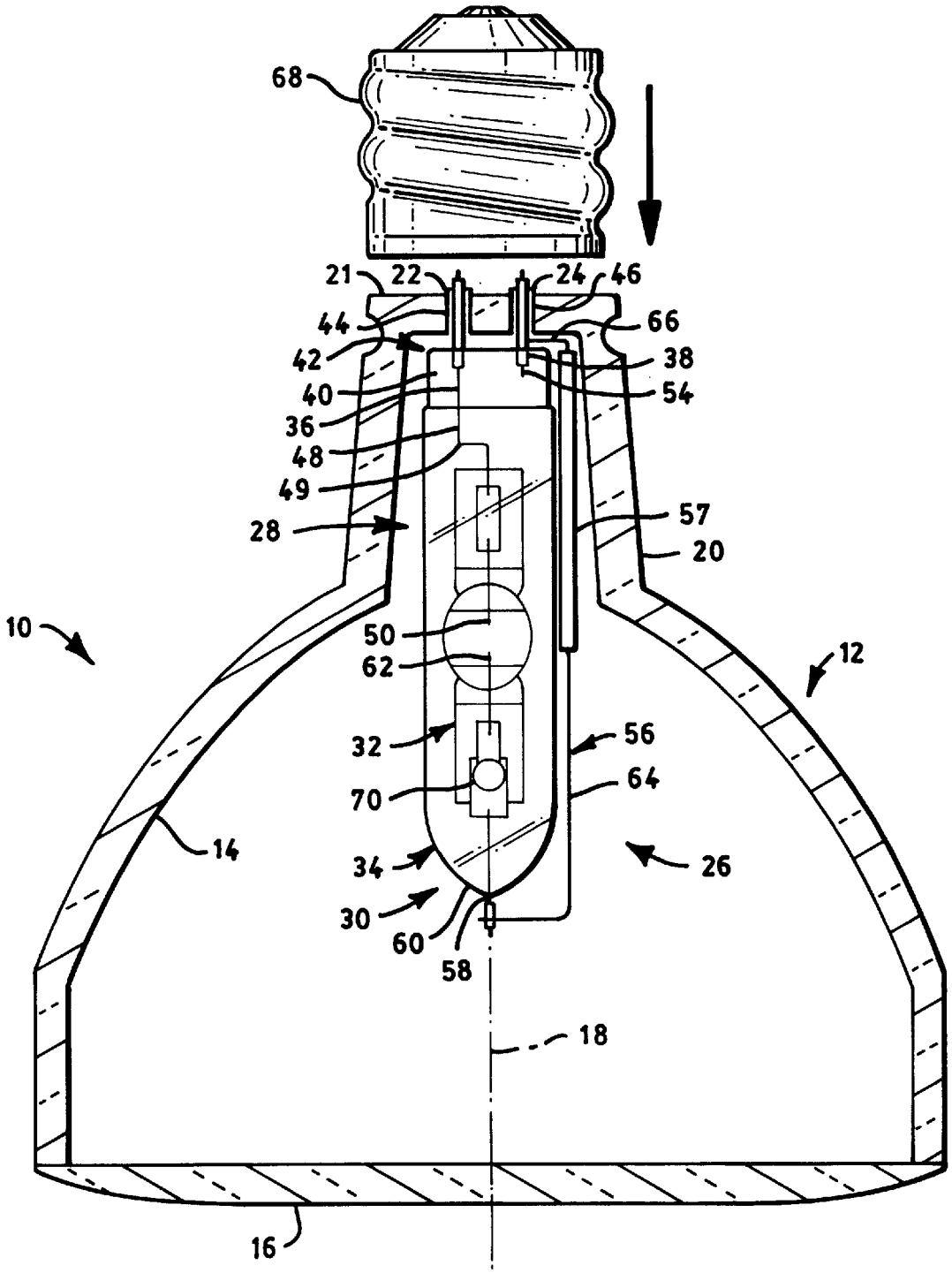
FIG. 1 is a sectional view of an embodiment of the invention.

Referring now to the invention with greater particularity, there is shown in FIG. 1 a reflector lamp 10 that comprises a vitreous outer envelope 12 formed of a concave reflector 14 and a light-transmitting 16 cover peripherally sealed thereto. The concave reflector and cover are symmetrically arrayed about a longitudinal axis 18 and a substantially cylindrical, hollow neck 20 having a given depth is affixed to the concave reflector opposite the cover. The neck 20 also is symmetrically arrayed about the longitudinal axis 18 and has a substantially closed bottom 21. At least two eyelets, 22, 24, respectively, are sealed in the bottom 21 and a light source capsule 26 is positioned in the concave reflector and aligned with the longitudinal axis 18. The light source capsule 26 has a first end 28 situated in the neck 20 and a second end 30 extending into the concave reflector. The light source capsule 26 comprises a quartz arc tube 32 containing an arc generating and sustaining medium and a surrounding aluminosilicate glass shroud 34. First and second conductive lead-ins 36, 38, respectively, are sealed into a first seal 40 formed at a first end 42 of the shroud 34. Each of the lead-ins 36, 38 has a first portion 44, 46, respectively, sealed in one of the eyelets 22, 24. The first conductive lead-in 36 has a second portion 48 extending interiorly of the shroud and connecting a first electrode 50 of the arc tube and contains a bend or offset 49 to take expansion differences during operation. The second lead-in 38 has a second portion 54 terminating within the first seal 40. An outer conductor 56 has a first end 58 vacuum scaled in a second end 60 of the shroud 34 and connects a second electrode 62 of the arc tube 32. A middle section 64 of the outer conductor 56, which can be surrounded by an electrically insulating sleeve 57 for at least part of its length, extends exteriorly of the shroud 34 and has a second end 66 connected to the second said lead-in 38. A conventional screw base 68 completes the lamp.

Figure 3:
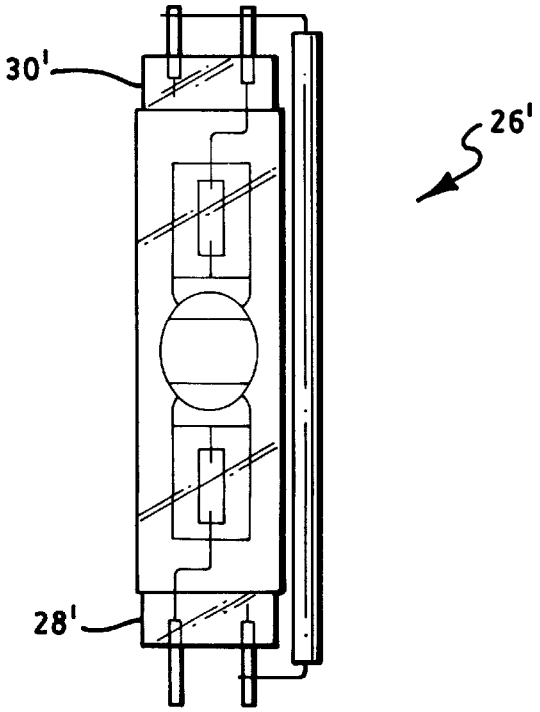
FIG. 3 is a sectional view of an alternate light source capsule configuration.

An alternative construction of the light source capsule is shown in FIG. 3, wherein a capsule 26' has both first end 28' and second end 30' formed with press seals.

Figure 2:
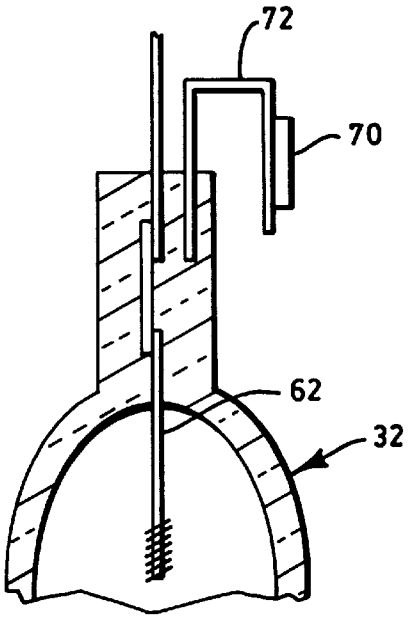
FIG. 2 is a sectional view of an end of the arc tube illustrating the floating lead of a getter support.

As noted, the lamp of this invention is ideally suited for low wattage applications, that is below 100 watts. In a first embodiment for a PAR30 lamp, a 50 watt variety employs 0.011" diameter electrodes, a vacuum outer jacket or shroud and an St707 getter 70 (available from SAES) mounted upon a getter support rod 72 (see FIG. 2) that is electrically floating. The St707 getter comprises, nominally, 7 wt. % Zr, 25 wt. % V and 5 wt. % Fe. The getter support rod 72 is pressed into the same press as electrode lead-in 62 but is spaced therefrom.

In a second embodiment for a PAR30 lamp, a 70 watt variety employs 0.015" diameter electrodes and a nitrogen fill at 400 torr in the volume between the shroud and the arc tube. An St198 getter, also manufactured by SAES, is used in the latter embodiment. The St198 getter comprises, nominally, 77 wt % Zr and 23 wt. % Fe. Both getters will absorb hydrogen, oxygenated gases (e.g., $O_2$, CO, $CO_2$) and water vapor. Additionally, the St707 will also getter quantities of nitrogen, if present.

Other getter can be utilized with different lamp parameters.

Preferably, the arc tubes are made from quartz tubing of a predetermined size, such as 6.20±0.25 mm OD with a wall thickness of 1.50±0.15 mm. To insure that the arc tubes are of a consistent size it is preferred that they be made by an automatic technique such as shown in U.S. Pat. No. 5,108,333. Additionally, suitably sized ceramic arc tubes can be employed.

In both lamp types the fill comprises about 1 to about 6 mg (with a preferred range of about 2 to about 4 mg) of a five component mix containing, in weight percent (wt. %), from about 52.00 to about 53.5 NaI; from about 3.00 to about 3.50 $ScI_3$; from about 16.6 to about 16.8 LiI; from about 22.8 to about 23.5 $DyI_3$; and from about 3.9 to about 4.2 TlI. In a preferred embodiment, the mix comprises 53.03 NaI; 3.16 $ScI_3$; 16.78 LiI; 22.93 $DyI_3$; and 4.1 TlI. Additionally, the fill includes about 4 mg Hg and 150 torr argon. The aluminosilicate glass is preferably GE 180 or Schott 8253f.

Thus there is provided a rugged, highly efficient, reflector lamp with good color rendition and long life and one that is economical to manufacture.

While there have been shown and described what are at present considered the preferred embodiments of the invention, it will be apparent to those skilled in the art that various changes and modifications can be made herein without departing from the scope of the invention as defined by the appended claims.

What is claimed is:

1. A reflector lamp comprising: a vitreous outer envelope formed of a concave reflector and a light-transmitting cover peripherally sealed thereto, said concave reflector and said cover being symmetrically arrayed about a longitudinal axis; a substantially cylindrical, hollow neck having a given depth affixed to said concave reflector opposite said cover, said neck being symmetrically arrayed about said longitudinal axis and having a bottom; eyelets sealed in said bottom; and a light source capsule positioned in said concave reflector, said light source capsule having a first end situated in said neck and a second end extending into said concave reflector, said light source capsule comprising an arc tube containing an arc generating and sustaining medium and a surrounding aluminosilicate glass shroud; first and second conductive lead-ins sealed into a first seal formed at a first end of said shroud, each of said lead-ins having a first portion sealed in one of said eyelets; said first conductive lead-in having a second portion extending interiorly of said shroud and connecting a first electrode of said arc tube; said second lead-in having a second portion terminating within said first seal; and an outer conductor having a first end sealed in a second end of said shroud and connecting a second electrode of said arc tube, a middle section extending exteriorly of said shroud, said middle section of said outer conductor being surrounded by an electrically insulating material, and a second end connected to said second said lead-in.

2. The reflector lamp of claim 1 wherein said arc generating and sustaining medium comprises a chemical fill containing about four mg of Hg; about 1 to about 6 mg of a five component mix consisting essentially of NaI, $ScI_3$, LiI, $DyI_3$ and TlI and an argon fill gas at about 150 torr.

3. The reflector lamp of claim 2 wherein the elements of said five component mix are present, in wt. %: from about 52.00 to about 53.5 NaI; from about 3.00 to about 3.50 $ScI_3$; from about 16.6 to about 16.8 LiI; from about 22.8 to about 23.5 $DyI_3$; and from about 3.9 to about 4.2 TlI.

4. The reflector lamp of claim 3 wherein said lamp is designed to operate at 50 watts and the volume between said shroud and said arc tube is evacuated.

5. The reflector lamp of claim 4 wherein said arc tube is provided with a floating lead and a getter is attached to said floating lead.

6. The reflector lamp of claim 5 wherein said elements of said five component mix are present, in wt. %, of 53.03 NaI; 3.16 $ScI_3$; 16.78 LiI; 22.93 $DyI_3$; and 4.1 TlI.

7. The reflector lamp of claim 2 wherein said lamp is designed to operate at 70 watts and the volume between said shroud and said arc tube is filled with 400 torr nitrogen.

8. The reflector lamp of claim 6 wherein said arc tube is provided with a floating lead and a getter is attached to said floating lead.

9. The reflector lamp of claim 2 wherein said arc generating and sustaining medium comprises a chemical fill containing about four mg of Hg; about 2 to about 4 mg of a five component mix consisting essentially of NaI, $ScI_3$, LiI, $DyI_3$ and TlI and an argon fill gas at about 150 torr.

10. The reflector lamp of claim 1 wherein said arc tube is formed from quartz.

* * * * *